US006304737B1

(12) United States Patent
Dotschkal

(10) Patent No.: US 6,304,737 B1
(45) Date of Patent: Oct. 16, 2001

(54) MOUNTING BOOT FOR A PHOTORECEPTOR BELT

(75) Inventor: Virginia E. Dotschkal, Newark, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/821,193

(22) Filed: Mar. 29, 2001

Related U.S. Application Data

(63) Continuation-in-part of application No. 09/590,177, filed on Jun. 9, 2000.

(51) Int. Cl.[7] ..... G03G 15/00
(52) U.S. Cl. ..... 399/117; 399/110
(58) Field of Search ..... 399/116, 110, 399/161, 162

(56) References Cited

U.S. PATENT DOCUMENTS 5,978,625 11/1999 Park ..... 399/116
6,049,682 4/2000 Goetzke et al. ..... 399/116

*Primary Examiner*—Quana M. Grainger
(74) *Attorney, Agent, or Firm*—Perman & Green, LLP

(57) ABSTRACT

A system in a xerographic apparatus which allows for a relatively easy, simple and fast method for mounting and positioning a AMAT photoreceptor belt onto the drive system frame and supporting structure for the belt. A flexible mounting boot is first placed over the photoreceptor frame and support structure and then the photoreceptor belt is positioned over the mounting boot such that the edges of the belt are prevented from catching onto any of the xerographic apparatus hardware thereby preventing damage to the belt. Thereafter the mounting boot is removed from the frame and support structure in such a manner so as to properly position the photoconductor belt on the frame and support structure. A certain amount of tensioning can then be applied to the photoconductive belt to allow it to move properly on its frame and support structure.

19 Claims, 6 Drawing Sheets

MOUNTING BOOT FOR A PHOTORECEPTOR BELT

RELATED APPLICATIONS

This application is a continuation-in-part of U.S. application Ser. No.09/590,177, filed Jun. 9, 2000 and titled: "MOUNTING BOOT FOR A PHOTORECEPTOR BELT"

BACKGROUND OF THE INVENTION

1. Field of the Invention

This invention relates generally to a reprographic printing machine, and more particularly, this invention relates to a system in a reprographic apparatus, such as a xerographic apparatus, for easily mounting and positioning a photoreceptor belt onto the frame and supporting structure for the belt. Even more particularly, this invention relates to a simple, fast and easy procedure for mounting and positioning an AMAT type photoreceptor belt onto the drive system frame and support structure for the belt, in a manner that substantially prevents damage to edges of the photoreceptor material.

A large belt photoreceptor, such as an AMAT belt, is very flexible and unwieldy for one person to handle without causing some damage to the belt and thereby incurring the resulting copy quality defects. The belt drive system in machines using a large belt is constructed with multiple components whose edges present obstacles to simply and easily sliding a belt onto the belt drive and support system. The edges of an AMAT belt tend to curl inward causing the edges to catch on the machine hardware, thereby creating a kink in the imaging area of the photoreceptor. The present invention provides a smooth covering over the drive system and support structure frame of a reprographic machine such that a frontal leading wedge can gently open up and shape the belt to conform the belt to the contours of the drive system and support structure, as the belt is slipped into place. The features of the present invention are also designed for use in manufacturing when the printing machines are initially outfitted with photoreceptors, and especially designed for use in the field by technical reps who are replacing AMAT type photoreceptor belts. Also the present invention can be used in belt finishing areas of a manufacturing process where inspections occur before packaging, or wherever a belt needs to be mounted on a rig.

2. Description of the Prior Art

Electrophotographic printing is a well known method of copying or printing documents by exposing a substantially uniformly charged photoreceptor to an optical light image of an original document, discharging the photoreceptor to create an electrostatic latent image of the original document on the photoreceptor's surface, selectively adhering toner to the latent image, and transferring the resulting toner pattern from the photoreceptor, either directly to a marking substrate such as a sheet of paper, or indirectly to a marking substrate after an intermediate transfer step. The transferred toner powder image is subsequently fused to the marking substrate using heat and/or pressure to make the image permanent. Finally, the surface of the photoreceptor is cleaned of residual materials and recharged in preparation for the creation of another image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for the production of different colored images and their respective complimentarily colored toner. Each single color toner image is transferred to the copy sheet in superimposed registration with the prior toner image. This create a multi-layered toner image on the copy sheet. Thereafter, the multi-layered toner image is permanently affixed to the copy sheet creating a color copy. The developer material may be a liquid or a powder material.

In the xerographic type processes described above the photoreceptor can be in the form of a belt driven photoreceptor that is both driven and positioned within the electrophotographic apparatus by a drive system (and corresponding supporting structure) which drives and supports the photoconductor belt in the xerographic apparatus.

By providing the above drive fame and support member, the photoconductive belt is driven and positioned at a predetermined location relative to the associated light source during exposure thereof. Moreover, the above drive frame and support member smoothes out the photoconductive belt as such belt is advanced through the imaging zone. As a result, the frame and support member provides for registration of the photoconductive member within the machine thereby reducing magnification and focus errors.

The drive frame and support member is positioned substantially adjacent the photoconductor in the imaging zone during normal operation of the machine. When it is desired to replace the photoconductor, due to wear or damage, the drive frame and support member may be temporarily positioned away from the photoconductive belt to assist in removal of the old photoconductor from the machine. After a new photoconductor is positioned within the machine, it is necessary to reposition the drive frame and support member back to a location substantially adjacent the photoconductor.

One problem which may occur during the above described procedure is failure of the person whom is performing the photoconductor belt replacement (normally a service technician), to avoid damaging the relatively delicate edges of the photoreceptor belt when the belt is mounted on the frame and support structure upon which the belt is driven and supported within the electrophotographic apparatus. It would be desirable to minimize physical damage to the photoreceptor belt; minimize the costly replacement of the photoreceptor belt; minimize possible printing or copy defects due to damage of the belt; and minimize adding to the overall aggregate service cost associated with maintenance of the electrophotographic printing apparatus.

U.S. Pat. No. 5,204,717 describes a bracket within an electrophotographic apparatus that is adapted to pivot so as to facilitate removal of a photoconductive belt.

Accordingly, it is a primary advantage of this invention to provide a system which prevents damage to a belt photoreceptor while it is mounted and positioned onto its drive frame and supporting structure within a reprographic printing apparatus. Other advantages include providing a means in the form of a flexible mounting boot that helps to make it easy to mount and position a photoconductive belt within an electrophotographic apparatus; providing a means to make it simpler to mount and position a photoconductive belt within a reprographic apparatus such that the process will avoid any damage to the belt thereby avoiding poor copy quality due to a damaged photoconductor; and minimizing adding to the aggregate service cost associated with maintenance of an electrophotographic printing apparatus particularly with regard to the replacement of a photoconductive belt. Additional advantages of the invention will be set forth in part in the description which follows and in addition a part will be obvious from the description, or may be learned by practice of the invention in accordance with the various features and combinations as particularly pointed out in the appended claims.

SUMMARY OF THE INVENTION

To achieve the advantages described herein in accordance with the purpose of the invention, the inventive features as embodied by the present invention include a method for easing the mounting and positioning of a photoreceptor belt onto the drive system frame and support structure for the photoreceptor in an electrophotographic printing apparatus. The specific method steps involved in practicing the present invention include first placing a mounting boot over the photoreceptor drive frame and support structure. Thereafter, the photoreceptor belt is positioned over the mounting boot such that the photoreceptor belt is properly positioned on the frame and support structure. The mounting boot substantially prevents the edges of the belt from catching on the apparatus hardwear as the belt is positioned on the machine. Thereafter, the mounting boot is removed from the frame and supporting structure such that the photoreceptor belt remains properly positioned on the frame and supporting structure. It is now ready for the apparatus to begin printing. Once the mounting boot is removed, the photoreceptor belt can be tightened or put under additional tension to avoid becoming too loose as it revolves in the printing machine during the printing process.

More specifically the apparatus for easing the mounting and positioning of a photoreceptor belt onto a photoreceptor drive frame and support structure in a xerographic apparatus in accordance with the features of the present invention such that physical damage to the photoconductor belt is substantially avoided or minimized comprises means adapted to partially cover the drive frame and support structure prior to the photoreceptor belt being properly positioned across the width of the frame and support structure.

An electrophotographic printing machine wherein an electrostatic latent image is recorded on an imaging surface of a photoconductive electrostatic image subsequently developed to form a visible image thereof, which is in accordance with the features of the present invention has as an improvement, means adapted to partially cover the drive frame and support structure prior to the belt being positioned on the drive frame and support structure.

BRIEF DESCRIPTION OF THE DRAWINGS

The accompanying drawings, which are incorporated in and constitute a part of the specification illustrate one embodiment of the invention and, together with the description, serve to explain the principles of the invention.

All references cited in this specification, and their references, are incorporated by reference herein where appropriate for teaching additional or alternative details, features, and/or technical background relating to the present invention.

While the present invention will be described hereinafter in connection with a preferred embodiment thereof, it should be understood that it is not intended to limit the invention to that embodiment. On the contrary, it is intended to cover all alternative, modifications and equivalents as may be included within the spirit and scope of the invention as defined by the appended claims.

DETAILED DESCRIPTION OF THE PREFERRED EMBODIMENT

For a general understanding of the features of the present invention, reference is made to the drawings. It will also become evident from the following discussion that the present invention is equally well suited for use in a wide variety of printing systems, and is not necessarily limited in its application to the particular printing system shown herein.

Figure 1:
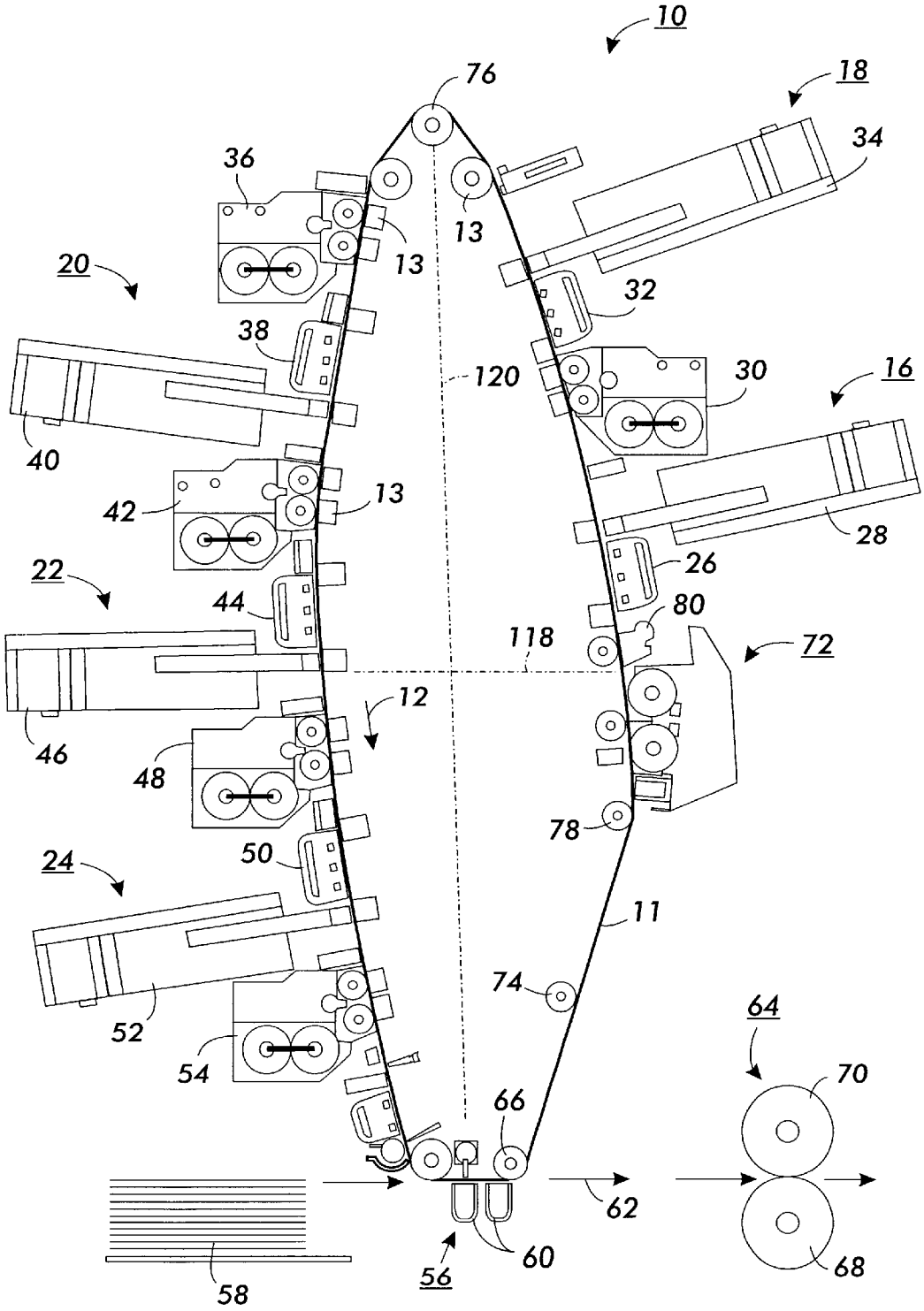
FIG. 1 is a partial schematic view of a printing apparatus that can be employed using the features of the present invention.

With reference to FIG. 1, there is shown a single pass multi-color printing machine 10. This printing machine employs a photoconductive belt 11, supported by a plurality of rollers or bars, 13. Photoconductive belt 11 is arranged in a vertical orientation. Belt 11 advances in the direction of arrow 12 to move successive portions of the external surface of photoconductive belt 11 sequentially beneath the various processing stations disposed about the path of movement thereof. The photoconductive belt has a major axis 120 and a minor axis 118. The major and minor axes are perpendicular to one another. Photoconductive belt 11 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, belt 11 passes through image recording station 16. Image recording station 16 includes a charging device and an exposure device. The charging device includes including a corona generator 26 that charges the exterior surface of photoconductive belt 11 to a relatively high, substantially uniform potential. After the exterior surface of photoconductive belt 11 is charged, the charged portion thereof advances to the exposure device. The exposure device includes a raster output scanner (ROS) 28, which illuminates the charged portion of the exterior surface of photoconductive belt 11 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 11, belt 11 continues to advance in the direction of arrow 14 to image recording station 18.

Image recording station 18 includes a recharging device and an exposure device. The charging device includes a corona generator 32 which recharges the exterior surface of photoconductive belt 11 to a relatively high, substantially uniform potential. The exposure device includes a ROS 34 which illuminates the charged portion of the exterior surface of photoconductive belt 11 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 11. After the magenta toner powder image has been developed on the exterior surface of photoconductive belt 11, photoconductive belt 11 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 11 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 11 to form a yellow toner powder image thereon. After the third electrostatic latent image has been developed with yellow toner, belt 11 advances in the direction of arrow 14 to the next image recording station 22.

Image recording station 22 includes a charging device and an exposure device. The charging device includes a corona generator 44, which charges the exterior surface of photoconductive belt 11 to a relatively high, substantially uniform potential. The exposure device includes ROS 46, which illuminates the charged portion of the exterior surface of photoconductive belt 11 to record a fourth electrostatic latent image for development with cyan toner particles. After the fourth electrostatic latent image is recorded on the exterior surface of photoconductive belt 11, photoconductive belt 11 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 11, photoconductive belt 11 advances to the next image recording station 24.

Image recording station 24 includes a charging device and an exposure device. The charging device includes a corona generator 50 which charges the exterior surface of photoconductive belt 11 to a relatively high, substantially uniform potential. The exposure device includes ROS 54, which illuminates the charged portion of the exterior surface of photoconductive belt 11 to selectively discharge those portions of the charged exterior surface of photoconductive belt 11 which are to be developed with black toner particles. The fifth electrostatic latent image, to be developed with black toner particles, is advanced to black developer unit 54.

At black developer unit 54, black toner particles are deposited on the exterior surface of photoconductive belt 11. These black toner particles form a black toner powder image which may be partially or totally in superimposed registration with the previously formed yellow and magenta toner powder images. In this way, a multi-color toner powder image is formed on the exterior surface of photoconductive belt 11. Thereafter, photoconductive belt 11 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 11 to the sheet of paper. Stripping axis roller 66 contacts the interior surface of photoconductive belt 11 and provides a sufficiently sharp bend threat so that the beam strength of the advancing paper strips from photoconductive belt 11. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 11. The photoconductive belt 11 moves over isolation roller 78 which isolates the cleaning operation at cleaning station 72. At cleaning station 72, the residual toner particles are removed from photoconductive belt 11. The belt 11 then moves under spots blade 80 to also remove toner particles therefrom.

It has been determined that belt tensioning member 74, preferably a roll, which is resiliently urged into contact with the interior surface of photoconductive belt 11, has a large impact on image registration. Heretofore, tensioning of the photoconductive belt was achieved by a roll located in the position of steering roll 76. In printing machines of this type, the image recording stations were positioned on one side of the major axis, with at most there being one image recording device on the other side thereof. Thus, there would be an image recording device on one side of the major axis of the photoconductive belt, separated by the tensioning roll, followed by four image recording devices positioned on the other side of the major axis of photoconductive belt 11. It has been determined that when the height of the photoconductive belt is reduced, requiring two image recording stations to be positioned on one side of the major axis and three image recording stations to be positioned on the other side of the major axis, image-to-image registration deteriorated. This has been overcome by changing the location of the tensioning roll as to position it between stripping roller 66 and isolation roll 78 adjacent cleaning station 72. This configuration enabled image-on-image registration to be maintained at the same levels as a printing machine of the previous type, provided that the tensioning mechanism was interposed between stripper roller 66 isolation roll 78. Tensioning roll 74 is mounted slidably on brackets. A spring resiliently urges tensioning roll 74 into contact with the interior surface of photoconductive belt 11 to maintain belt 11 at the appropriate tension.

Figure 2:
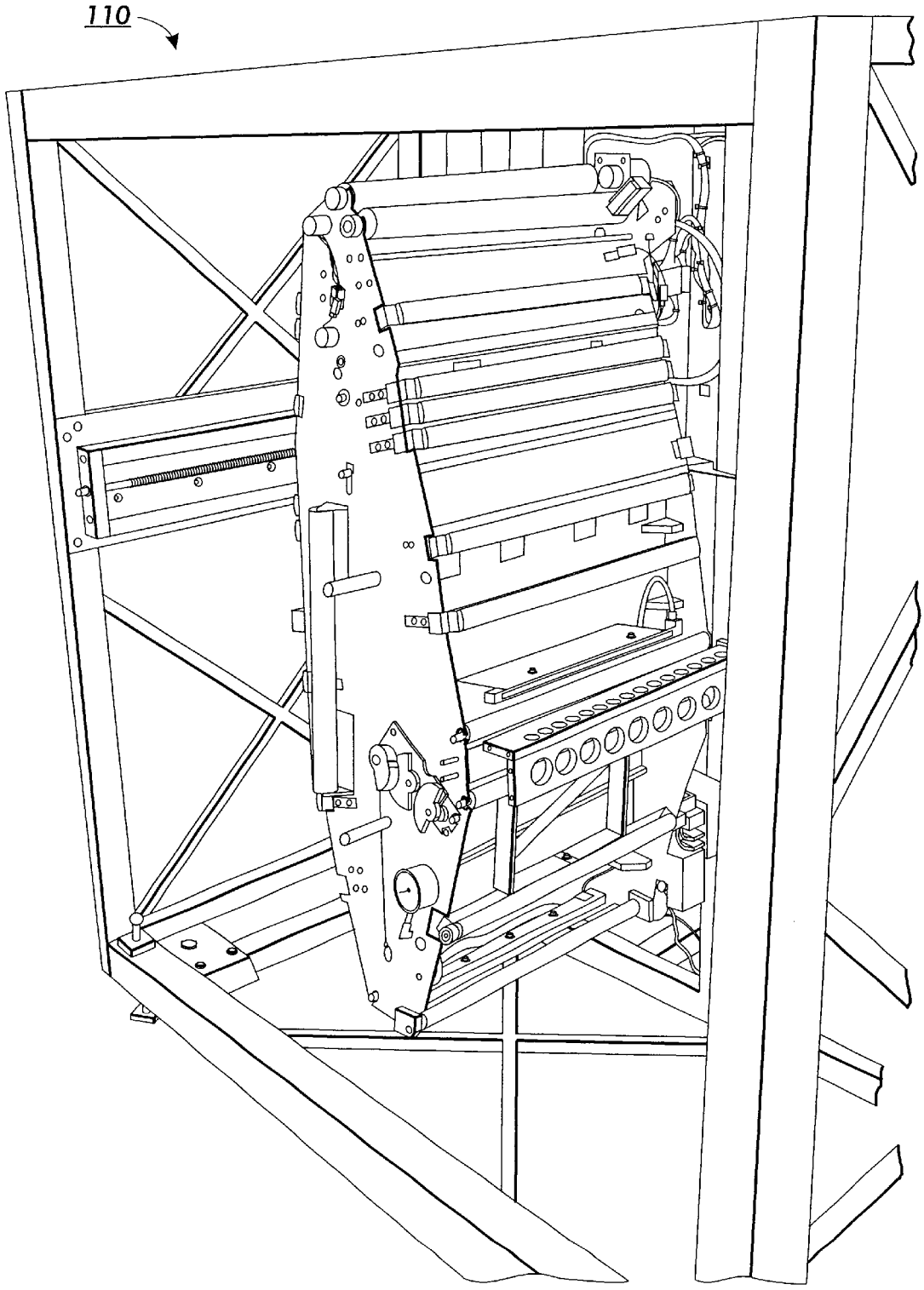
FIG. 2 is a partial perspective view of the drive frame and supporting structure for an electrophotographic printing apparatus prior to a photoconductive belt being positioned thereon.
Figure 3:
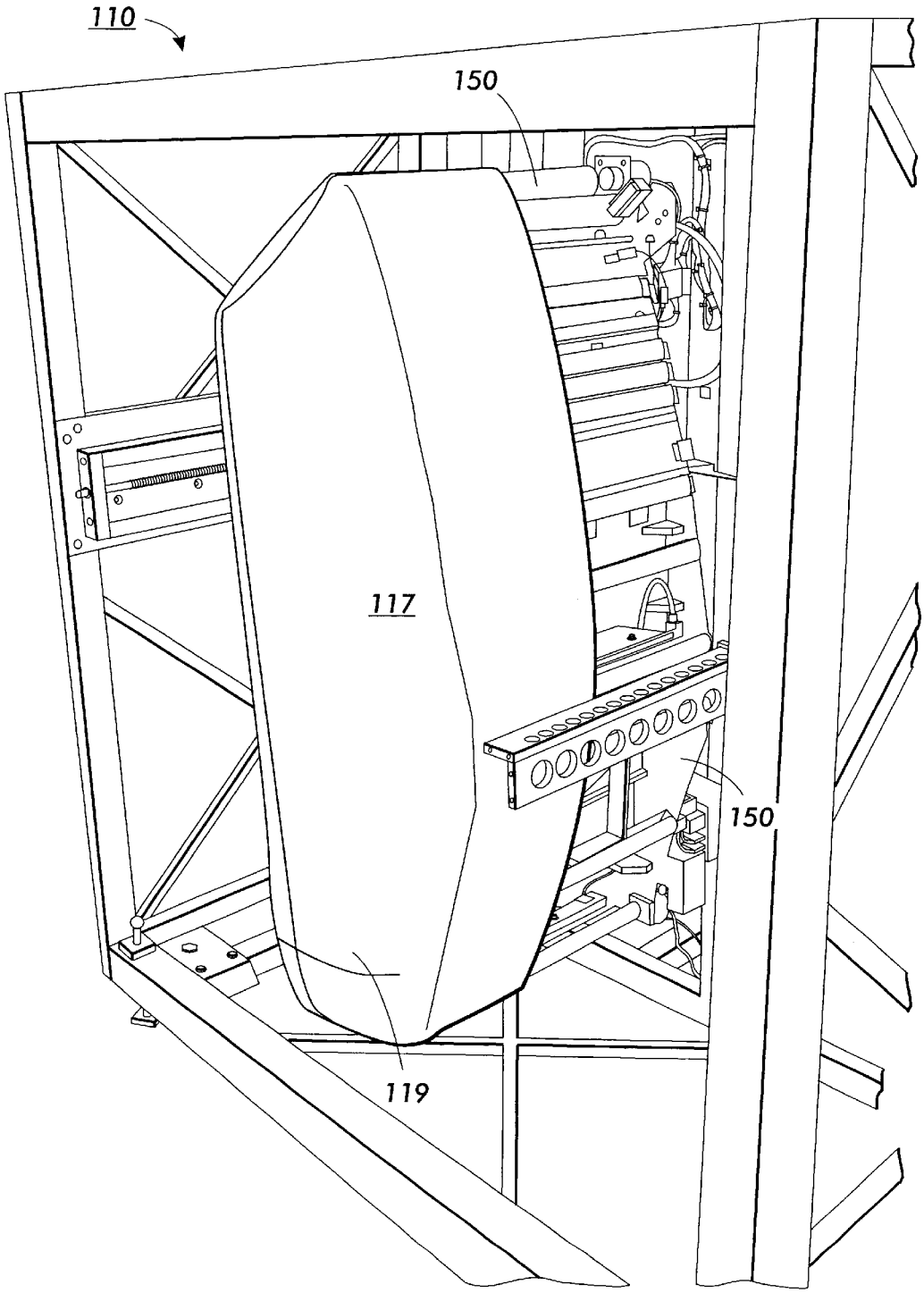
FIG. 3 is a partial perspective view of the electrophotographic printing apparatus as illustrated in FIG. 2 illustrating one embodiment of a mounting boot being positioned in place in accordance with the features of the present invention.

Turning now to the primary features of the present invention and FIG. 2 and FIG. 3, there is shown in accordance with the present invention an example of an apparatus that will ease the mounting and positioning of a photoreceptor belt or AMAT photoreceptor belt onto a electrophotographic machine 110, in such a manner so as to substantially minimize physical damage to the belt in the process of belt replacement. In accordance with the features of the present invention, mounting boot 117 is first positioned or slipped over the mounting surface (i.e. the drive system frame and support structure 150) for the photoreceptor belt. The term "boot" means "a sheath or casing or similar protective apparatus that provides a protective covering for an object or mechanism". The mounting boot 117 is just that, i.e. a sheath that provides a protective covering for the drive frame and support structure 150. The mounting boot 117 is preferably constructed or formed of a lightweight flexible material such as, for example, a vinyl material that will be easy for a field technical representative to carry and handle. Depending on the specific needs involved, the mounting boot 117 can be constructed of a more rigid material and produced, for example, by an injection molding process or some other molding technique. The mounting boot 117 could be used as a service tool either carried by a service representative or stored within the electrophotographic machine 110 or packaged as a disposable item together with each photoreceptor belt. In positioning the mounting boot 117 on the drive system frame and support structure 150 of the electrophotographic apparatus 110, the mounting boot will, as shown in FIG. 3, overlay the whole length of the belt drive and support structure 150 in a manner such that the edges of the photoconductor belt do not catch and kink on any of the hardware. In accordance with the features of the present invention and as illustrated in FIG. 3, the mounting boot 117 is initially positioned on about ⅓ of the width of the drive frame and supporting structure 150.

The mounting boot 117 can be manufactured on, for example any sewing machine and can be constructed of one or more pieces of material. The boot 117 is preferably constructed of a flexible material but can be made of a rigid material, such as an injection molded plastic. Depending on the type of vinyl material used for the boot, the seams thereof could be heat welded or glued. A velcro closure could also be another system that can be used in accordance with the present invention to help construct the mounting boot 117. The mounting boot 117, as shown, was constructed specifically for a flexible photoreceptor such as an AMAT belt. However, the mounting boot can be used for installing any belt type photoreceptor. The boot illustrated in this embodiment is 106 inches in diameter and 22 inches deep. One 4 inch wide dart is sewn at the top portion of the boot for a depth of 11 inches. Three 2 inch wide darts are sewn at the bottom. The forward edge of the boot 117 is sewn closed. This forms a wedge like surface 119 on which the AMAT belt glides into place (See FIG. 3 and FIG. 4). In the middle of each side of the boot is a 10 inch deep slit extending from the back edge. Elastic banding strips are sewn into the slit. This elastic provides for a snug fit of the boot 117 over the drive frame and support structure 150 and allows for easier placement and removal of the boot. In accordance with the features of the present invention, the mounting boot diameter depth, number of darts and placement of darts can be adjusted to accommodate any electrophotographic machine design using any size AMAT or any other photoconductive belt structure.

Figure 4:
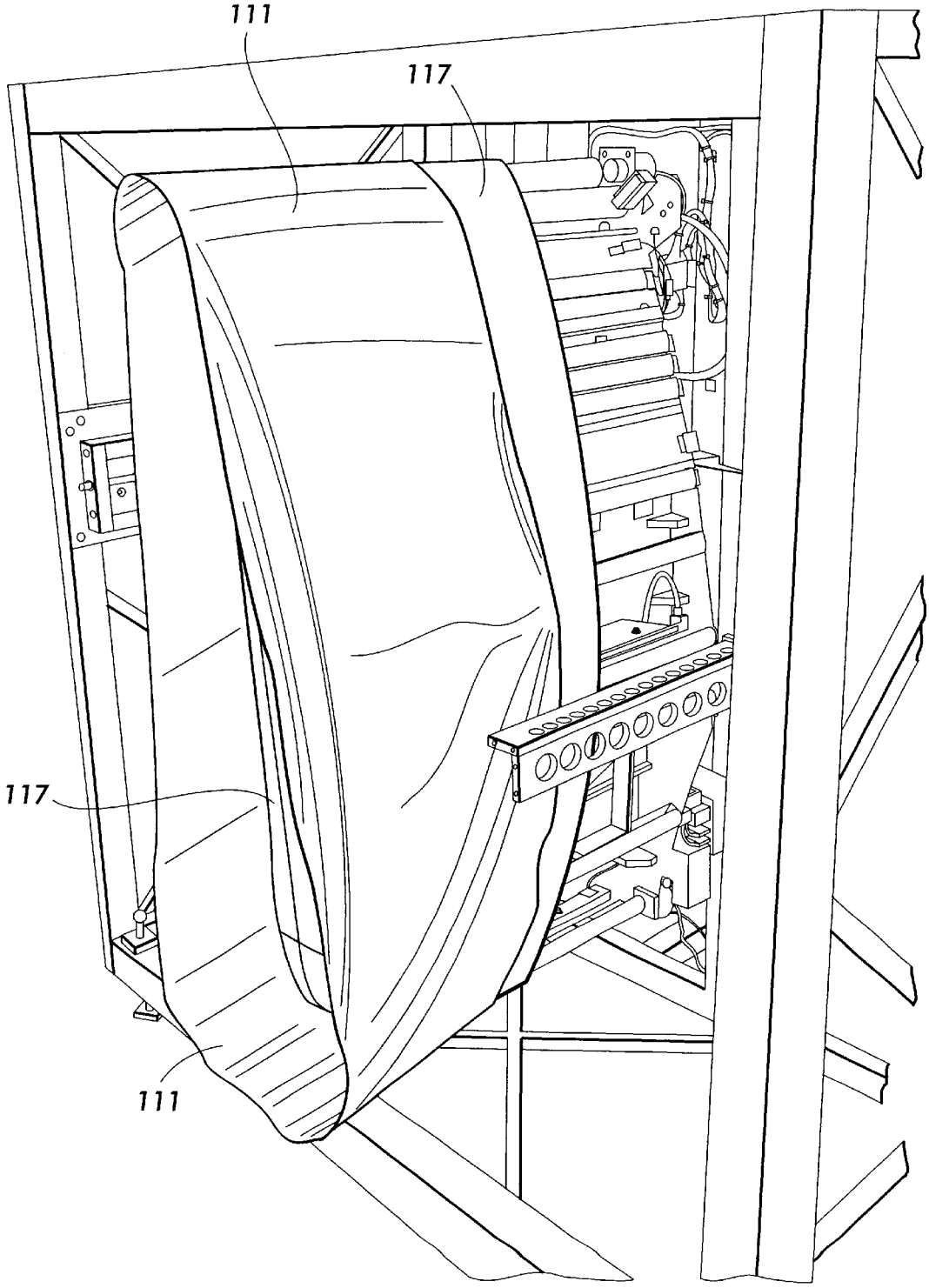
FIG. 4 is a partial perspective view of the electrophotographic printing apparatus as illustrated in FIG. 2 with a photoconductive belt being positioned over the mounting boot in accordance with the features of this invention.
Figure 5:
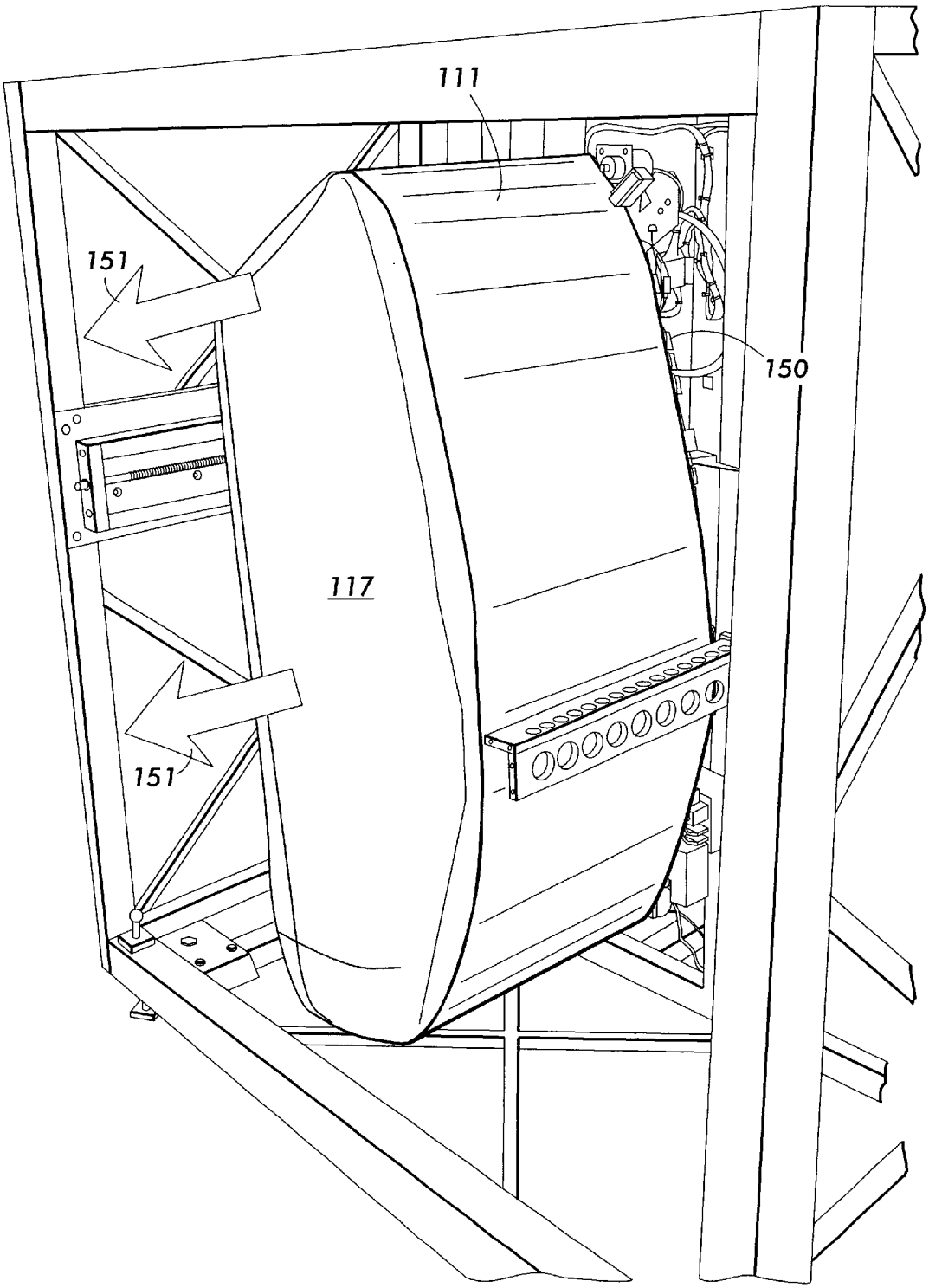
FIG. 5 is a partial perspective view of the electrophotographic printing apparatus as illustrated in FIG. 2 with a photoconductive belt corrected positioned on the machine or apparatus with the mounting boot starting to be removed from the structure in accordance with the features of this invention.
Figure 6:
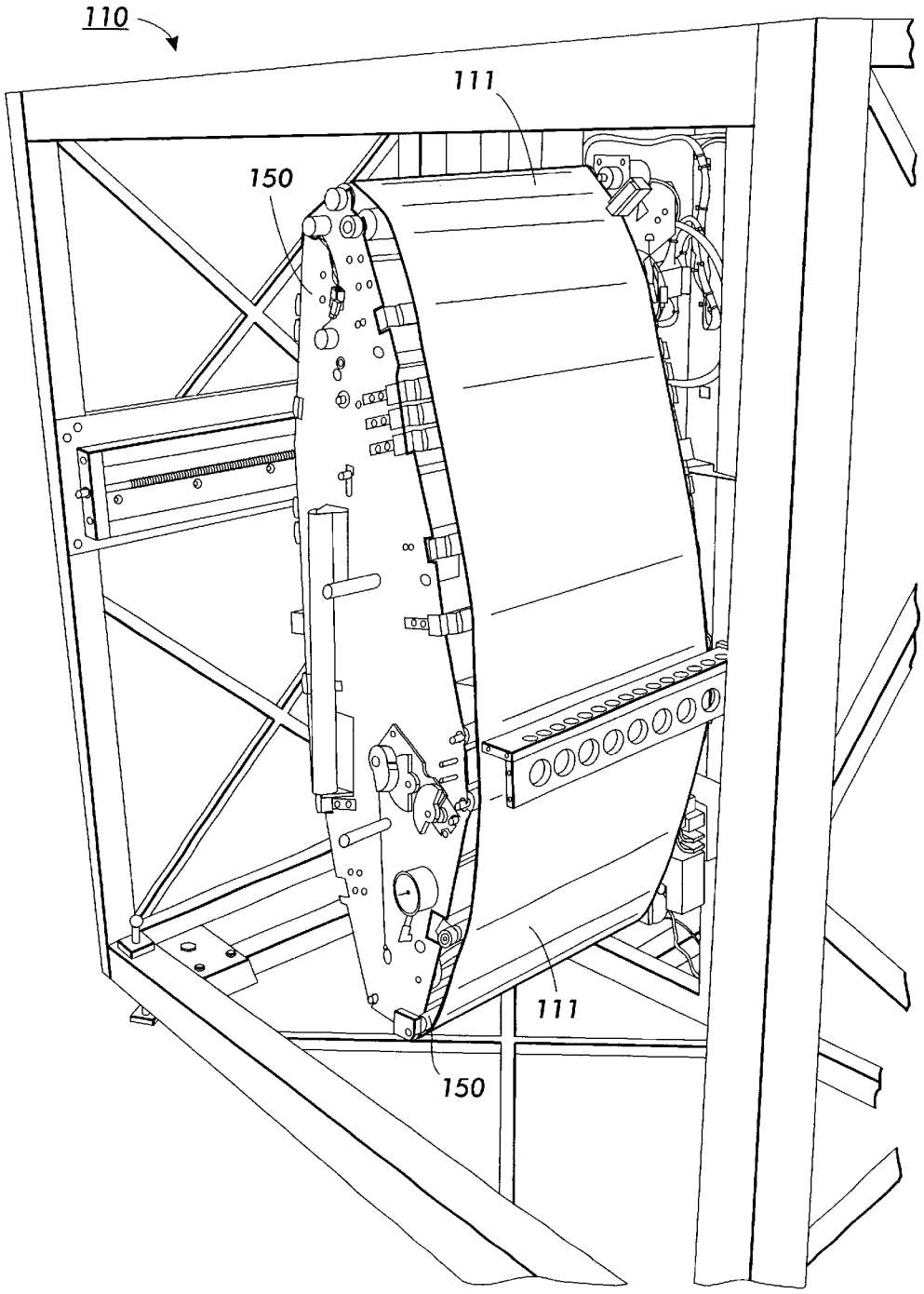
FIG. 6 is a partial perspective view of the electrophotographic printing apparatus as illustrated in FIG. 2 with a belt type photoconductor that has been mounted correctly in place on the apparatus without damage to the belt by using a mounting boot in accordance with the features of the present invention.

FIG. 4 illustrates a procedure for slipping or positioning the photoreceptor belt 111 over the mounting boot 117. FIG. 5 illustrates the next step in the process wherein once the photoreceptor belt 111 is properly positioned on the drive frame and support structure 150, the mounting boot is easily removed from frame and structure 150 in the direction of arrows 151 (See FIG. 4). This process will leave the photoreceptor belt 111 properly positioned within the electrophotographic apparatus 110 as illustrated in FIG. 6 wherein the mounting boot has now been completely removed.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for easing the mounting and positioning of a photoreceptor belt onto the drive system frame and support structure for the photoreceptor in a electrophotographic printing apparatus comprising:

(a) placing a mounting boot over the photoreceptor drive frame and support structure;

(b) positioning the photoreceptor belt over the mounting boot such that the photorecpor belt is properly positioned on the frame and support structure, the boot substantially preventing the edges of the belt from catching on the apparatus; and (c) removing the mounting boot from the frame and support structure in such a manner so as to properly position the photoreceptor belt substantially on the frame and support structure ready for printing.

2. A method as in claim 1 further comprising the step of tensioning said photoreceptor belt after removing said boot.

3. A method as in claim 2 wherein said photoreceptor belt is an AMAT belt.

4. A method as in claim 3 wherein said mounting boot is constructed of a lightweight flexible material.

5. A method as in claim 4 wherein said boot material is a vinyl material.

6. A method as in claim 4 wherein said boot is constructed of two or more pieces of material.

7. A method as in claim 1 wherein said boot is a flexible wedge shaped boot.

8. A method as in claim 1 wherein said mounting boot is partially positioned across the width of said frame.

9. A method as in claim 1 wherein said boot material is produced by a molding process.

10. A method as in claim 8 wherein said molding process is an injection molding process.

11. Apparatus for easing the mounting and positioning of a photoreceptor belt onto the photoreceptor frame and support structure in a reprographic apparatus such that physical damage to the photoreceptor is minimized comprising a boot adapted to partially cover the frame and support structure of the photoreceptor prior to the photoreceptor belt being properly positioned across the width of the frame and support structure, the photoreceptor belt being properly positioned on the frame and support structure by the boot that is adapted to substantially prevent the edges of the belt from catching on the frame and support structure.

12. Apparatus according to claim 11 wherein said boot is a flexible mounting boot.

13. Apparatus according to claim 11 wherein said photoreceptor belt is an AMAT belt.

14. Apparatus according to claim 11 wherein said boot is adapted to be positioned on a portion of the width of said frame and support structure.

15. Apparatus according to claim 14 wherein said boot is adapted to be positioned on about ⅓ of the width of said frame and support structure.

16. An electrophotographic printing machine wherein an electrostatic latent image is recorded on an imaging surface of a photoconductive belt and is subsequently developed to form a visible image thereof, wherein the improvement comprises: a mounting boot adapted to partially cover the frame and support structure of the photoreceptor belt prior to the belt being positioned on the frame and support structure, the mounting boot being adapted to be removed from the frame and support structure after the belt is positioned on the frame and support structure, the photoreceptor belt being properly positioned on the frame and support structure by the boot that is adapted to substantially prevent the edges of the belt from catching on the frame and support structure of the apparatus.

17. An electrophotographic printing machine according to claim 16 wherein said mounting boot is constructed of a lightweight flexible material.

18. An electrophotographic printing machine according to claim 17 wherein said flexible material is a vinyl material.

19. A method for easing the mounting and positioning of a photoreceptor belt onto the drive system and frame and support structure for the photoreceptor in a electrophotographic printing apparatus comprising:

(a) placing a mounting boot over the photoreceptor drive frame and support structure; and (b) removing the mounting boot from the frame and support structure in such a manner so as to position a photoreceptor belt substantially properly on the frame and support structure and ready for printing, the boot being adapted to substantially prevent edges of the belt from catching on the frame and support structure of the apparatus.

* * * * *